US006107746A

United States Patent [19]

Chen

[11] Patent Number: 6,107,746

[45] Date of Patent: Aug. 22, 2000

[54] THREE-WIRE CHRISTMAS FLASHING CONTROL LAMP

[76] Inventor: Johnny Chen, No. 2, Alley 2, Lane 626, Chung Chen Ld., Hsinchu City, Taiwan

[21] Appl. No.: 09/176,225

[22] Filed: Oct. 21, 1998

[51] Int. Cl.[7] ..... H05B 37/00

[52] U.S. Cl. ..... 315/185 R; 315/94; 315/185 S

[58] Field of Search ..... 315/94, 101, 102, 315/107, 105, 106, 71, 51, 50, 185 S, 185 R, 362; 313/492

[56] References Cited

U.S. PATENT DOCUMENTS 3,594,777 7/1971 Blair ..... 340/334

5,004,949 4/1991 Latassa et al. ..... 313/492

*Primary Examiner*—David H. Vu

*Attorney, Agent, or Firm*—Dougherty & Troxell

[57] ABSTRACT

A three-wire Christmas flashing control lamp includes a filament, a bimetal plate, and three conductive poles installed in the lamp. Three conductive wires are extended from the bottom end of the lamp. The lamp is mounted on a lamp base and then received by a lamp holder. The three-wire Christmas flashing control lamp is used to control the switching operation of a Christmas light string to further control the flickering effect of the light string.

6 Claims, 6 Drawing Sheets

THREE-WIRE CHRISTMAS FLASHING CONTROL LAMP

BACKGROUND OF THE INVENTION

1. Field of the Invention

The present invention relates to an improved structure of a Christmas flashing control lamp, and more especially to a three-wire Christmas flashing control lamp.

2. Description of the Prior Art

The prior art Christmas light string is formed by a two-wire flashing control lamp 10 electrically connected with a series of regular lamps 11, as shown in FIG. 1. An electric power source is then supplied to the Christmas light string via an electric plug 2. The flashing control lamp 10 includes a bimetal plate therein. The illumination of the light string is controlled by the heating state of the bimetal plate in the flashing control lamp.

Referring to FIG. 2, a perspective view of the prior art two-wire flashing control lamp 10 is shown. The two-wire flashing control lamp 10 includes two conductive poles 12 and 13 which are connected with exterior conductive wires. A filament 14 is connected between two ends of the conductive poles 12 and 13. A bimetal plate 15 having a lower free end is connected with the first conductive pole 12. When the conductive poles 12 and 13 are supplied with an electric power source, the filament 14 is heated. After a predetermined time is reached, the lower free end of the heated bimetal plate 15 will bend to contact with the second conductive pole 13 so that the two conductive poles 12 and 13 will short to bypass the electric current flow through the filament 14. At this time, the temperature in the lamp will be cooled down.

After the temperature within the bulb has decreased to a predetermined level, the bimetal plate 15 will return to the original state. Therefore, by means of the aforementioned switching operation, the flickering effect of the light string may be controlled. However, in the circuit of this prior art Christmas light string, the light string can only create a monotonous flashing effect without various flickering patterns. Therefore, it is necessary to provide a three-wire Christmas flashing control lamp which has contact switching function so that the light string can achieve a various flickering effect.

Accordingly, the object of the present invention is to provide a three-wire flashing control lamp structure of Christmas lamps, wherein by the structure of the three-wire flashing control lamp matches a simple circuit design and arrangement, the diversified flickering effects can be presented.

The present invention will be better understood and its numerous objects and advantages will become apparent to those skilled in the art by reference to the following drawings in which:

DETAILED DESCRIPTION OF THE PREFERRED EMBODIMENT

Figure 1:
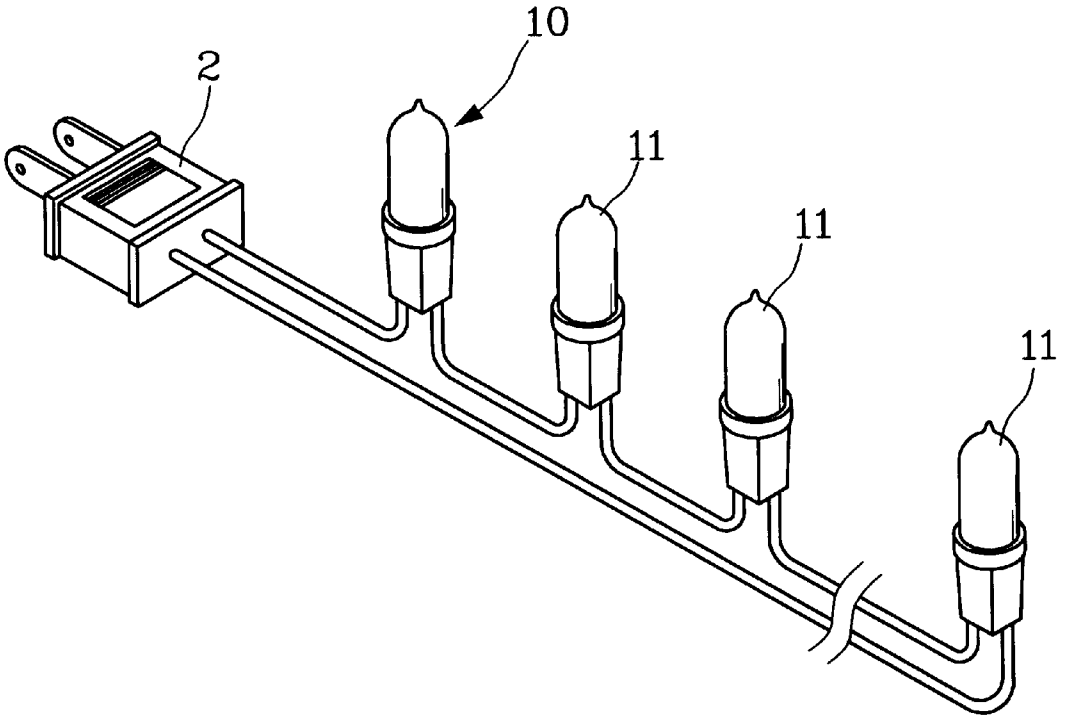
FIG. 1(PRIOR ART)
FIG. 1 is a schematic perspective view of a prior art Christmas light string.
Figure 2:
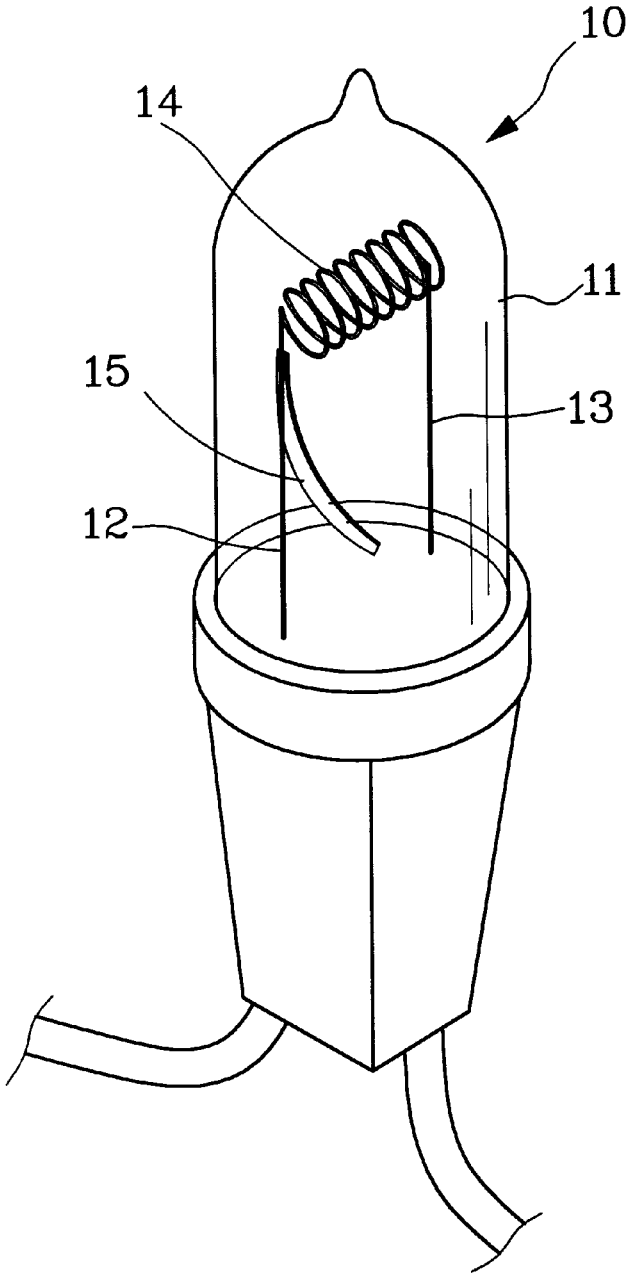
FIG. 2(PRIOR ART)
FIG. 2 is a perspective view of a prior art two-wire flashing control lamp.
Figure 3:
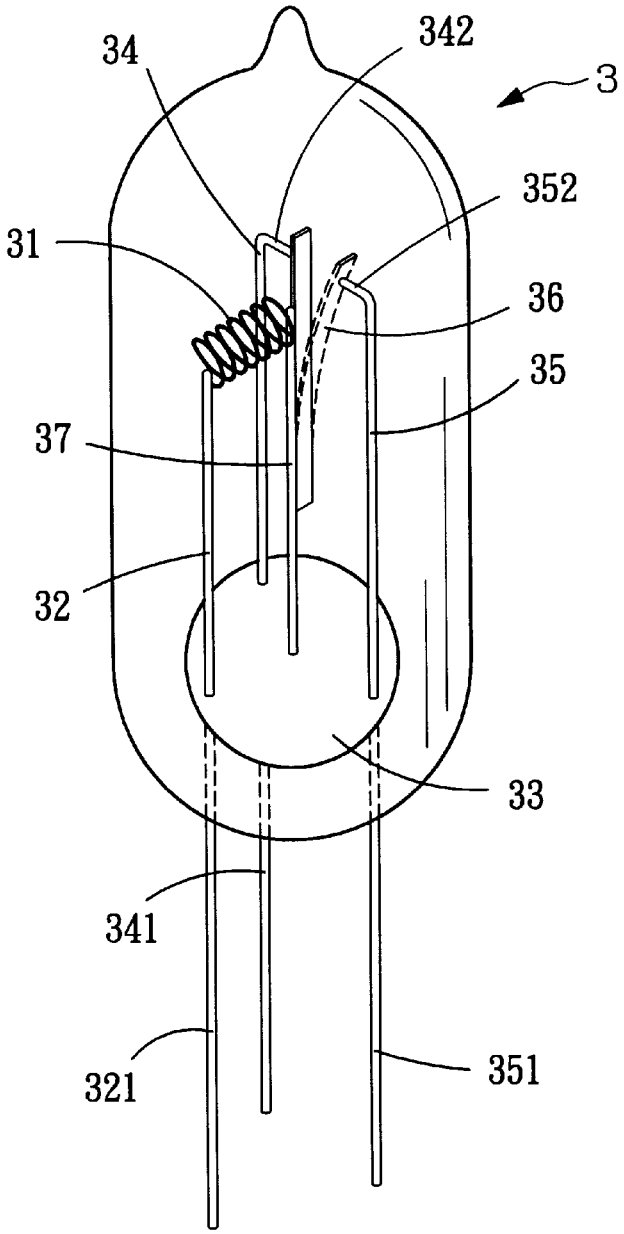
FIG. 3 is a perspective view showing the three-wire flashing control lamp in accordance with the first embodiment of the present invention.

As shown in FIG. 3, it is a perspective view showing the three-wire flashing control lamp 3 of the present invention. The flashing control lamp 3 of the present invention includes first, second and third conductive poles 32, 34, 35, a filament 31, a central pole 37, and a bimetal plate 36. The two ends of the filament 31 are connected with the first conductive pole 32 and the central pole 37. The central pole 37 is connected with the bimetal plate 36 by welding, while one end of the bimetal plate 36 will become a free end.

The first, second and third conductive poles 32, 34, 35 and central pole 37 are positioned by a glass positioning ball 33 in the control lamp 3. Then, the first conductive pole 32, the second conductive pole 34, and the third conductive pole 35 extend to form a first conductive wire 321, a second conductive wire 341 and a third conductive wire 351 respectively.

When an external electric power source is not supplied to the first and second conductive pole 32 and 34, the bimetal plate 36 contacts the second conductive pole 34. When an external electric power source is supplied to the first conductive wire 321 and the second conductive wire 341, the flashing control lamp 3 will light and generate heat within the lamp. When a predetermined time has elapsed, the bimetal plate 36 will bend by heating, separate from the second conductive pole 34, and then contact with the third conductive pole 35. At this time, in case that the electric power source is not supplied to the first conductive wire 321 and the second conductive wire 341, the bimetal plate 36 will cool down and return to the original position. Therefore, by means of the flashing control lamp, a light string will present a flickering effect. Moreover, since the bulb has three conductive wires, various flickering effects may be achieved.

In order to meet the bending direction of the bimetal plate 36, the second conductive pole 34 and the third conductive pole 35 are provided with bent sections 342 and 352 respectively on the top end thereof, so as to ensure that the heated bimetal plate 36 can contact with the conductive poles 34 and 35.

Figure 4:
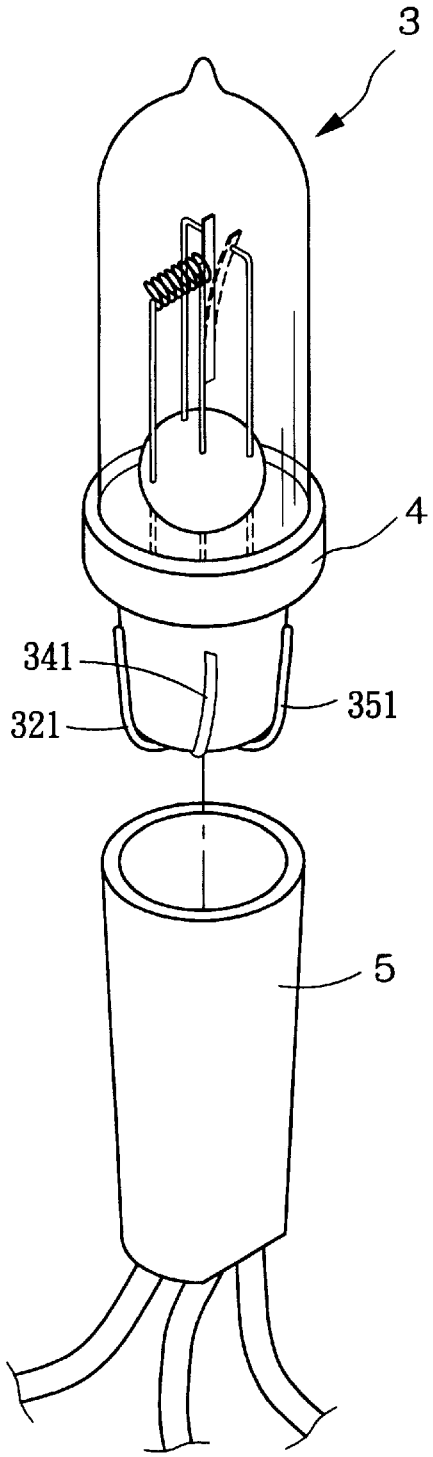
FIG. 4 is a schematic perspective view showing the three-wire flashing control lamp is mounted on a lamp base, and then received in a lamp holder.

Referring now to FIG. 4, the three-wire flashing control lamp 3 is first mounted on a lamp base 4. The first, second and third conductive wires 321, 341 and 351 are extended from the bottom end of the lamp base 4. Next, the first, second and third conductive wires 321, 341 and 351 are bent upward to bear against the outer side wall of the lamp base 4. Finally, the lamp base 4 is mounted into a top open end of a lamp holder 5.

Figure 5:
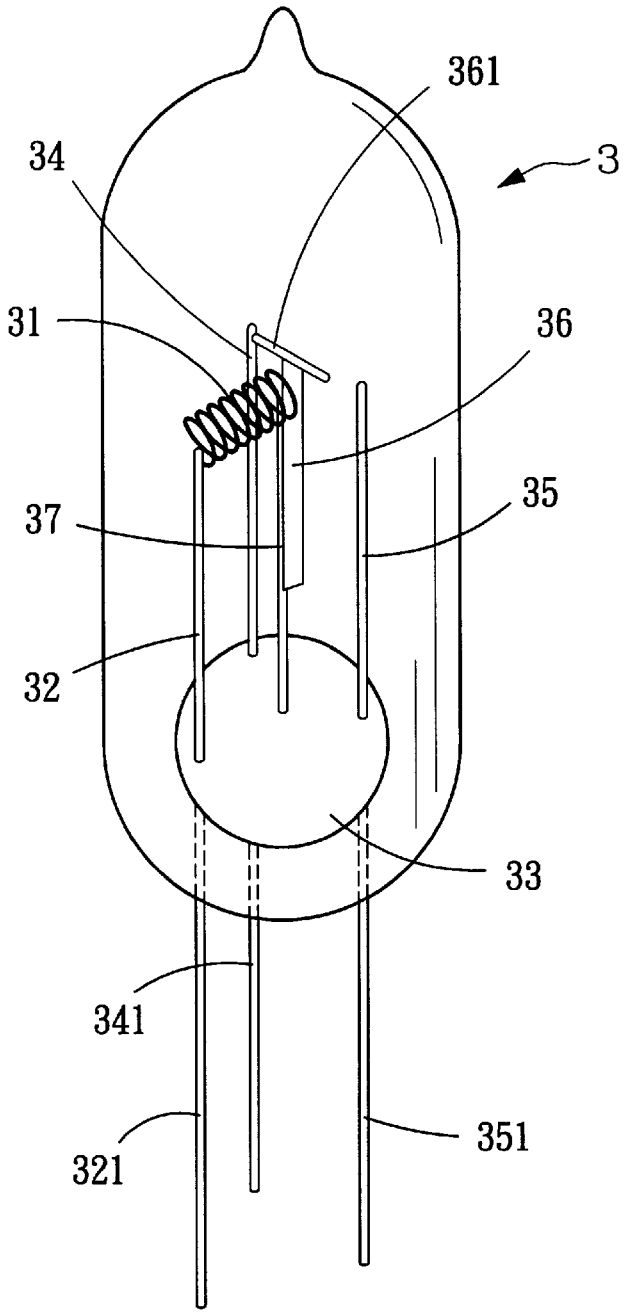
FIG. 5 is a perspective view showing the three-wire flashing control lamp in accordance with the second embodiment of the present invention.

FIG. 5 shows a perspective view showing the second embodiment of the present invention. Most of the structure of this embodiment is identical to that of the first embodiment, except that there are no bent sections formed on the top end of the second conductive pole 34 and third conductive pole 35. Alternatively, a horizontal section 361 is formed on the top end of the bimetal plate 36 in order to ensure that the bimetal plates 36 can contact with the third conductive pole 35 when heating but it can contact with the second conductive pole 34 when the temperature in the lamp is cooled down.

Figure 6:
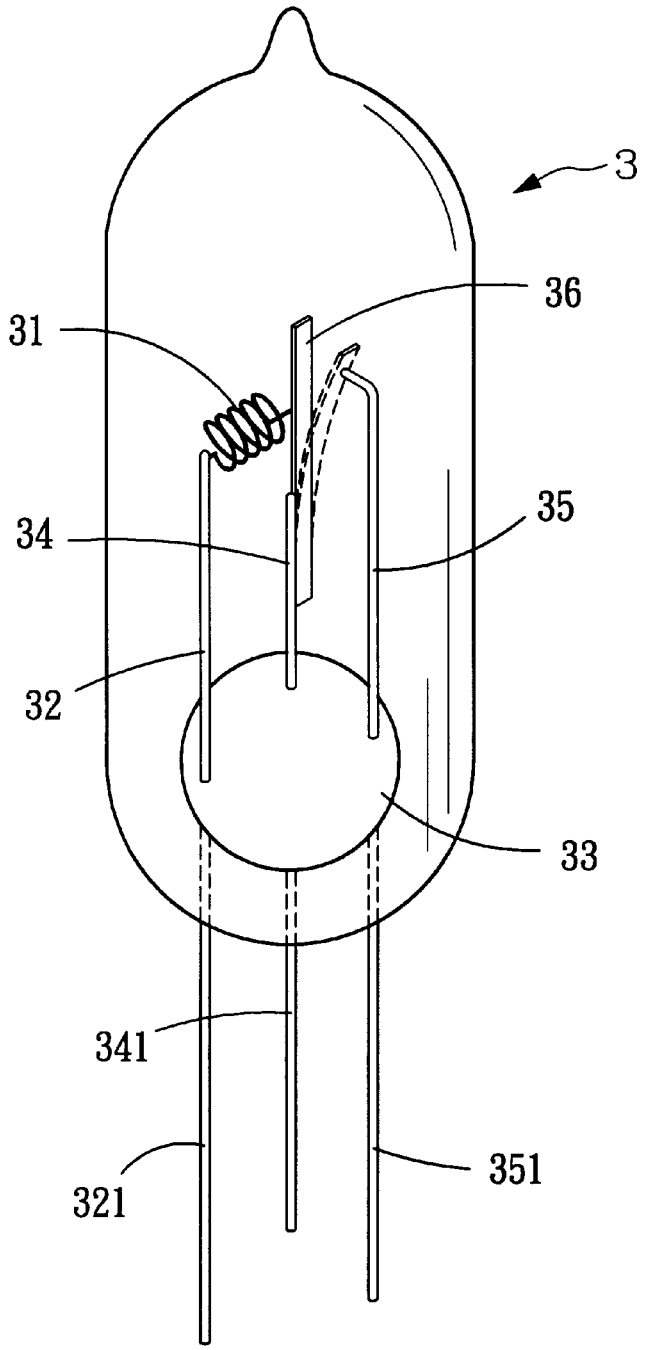
FIG. 6 is a perspective view showing the three-wire flashing control lamp in accordance with the third embodiment of the present invention.

The perspective view of the third embodiment of the present invention is shown in FIG. 6. Most of the structure of this embodiment is identical to that of the first embodiment, except that in the three-wire flashing control lamp 3, instead of being installed with a central pole, only a first conductive pole 32, a second conductive pole 34, and a third conductive pole 35 are installed therewithin. In addition, the bimetal plate 36 is welded directly on the second conductive pole 34. The filament is connected between the first conductive pole 32 and the second conductive pole 34.

In operation, when the first conductive pole 32 and the second conductive pole 34 are supplied with an electric power source, heat is generated within the flashing control lamp. After a predetermined time has been elapsed, the bimetal plates 36 will bend by heating to contact with the third conductive pole 35. When the first conductive pole 32 and the second conductive pole 34 are not supplied with the electric power source, the bimetal plate will cool down and separate from the third conductive pole 35.

Although the present invention has been described using specified embodiments, the examples are meant to be illustrative and not restrictive. It is clear that many other variations would be possible without departing from the basic approach, demonstrated in the present invention.

What is claimed is:

1. A three-wire flashing control lamp comprising:

a central pole;

a bimetal plate, having a first end attached to the central pole and a second free end;

a first conductive pole;

a second conductive pole installed adjacent to the central pole;

a third conductive pole installed adjacent to the central pole and the second conductive pole; and a filament connected between the first conductive pole and the central pole;

wherein the central pole, the first, second and third conductive poles, and the bimetal plate are each arranged substantially vertically within the lamp; and wherein the free end of the bimetal plate contacts with the second conductive pole when not heated by current from the first and second conductive poles, the free end bends away from said second conductive pole when heated by said current and contacts with the third conductive pole, and the free end returns after cooling to contact the second conductive pole, thereby creating a flickering effect.

2. The three-wire flashing control lamp as recited in claim 1, wherein the second conductive pole and the third conductive pole are provided with bent sections respectively on top ends thereof.

3. The three-wire flashing control lamp as recited in claim 1, wherein the bimetal plate is provided with a horizontal section on a top end thereof.

4. The three-wire flashing control lamp recited in claim 1, wherein the first, second and third conductive poles are connected to first, second and third conductive wires, respectively, which extend from the bottom of the lamp.

5. A three-wire flashing control lamp comprising:

a first conductive pole;

a second conductive pole;

a bimetal plate, having a first end attached to the second pole and a second free end;

a third conductive pole installed adjacent to the second conductive pole; and a filament connected between the first conductive pole and the bimetal plate;

wherein the free end of the bimetal plate is separated from the third conductive pole when not heated, while the free end of the bimetal plate bends and contacts with the third conductive pole when heated, thereby creating a flickering effect, wherein the first, second and third conductive poles, and the bimetal plate are each arranged substantially vertically within the lamp.

6. The three-wire flashing control lamp recited in claim 5, wherein the first, second and third conductive poles are connected to first, second and third conductive wires, respectively, which extend from the bottom of the lamp.

* * * * *